United States Patent [19]

Muggeo et al.

[11] Patent Number: 5,005,756

[45] Date of Patent: Apr. 9, 1991

[54] METHOD OF PRODUCING BIMETALLIC TUBES AND THE TUBES OBTAINED BY THIS METHOD

[75] Inventors: Alain Muggeo; Denis Vuillaume, both of Montbard, France

[73] Assignee: Valinox, Boulogne-Billancourt, France

[21] Appl. No.: 460,539

[22] Filed: Jan. 3, 1990

[30] Foreign Application Priority Data

Jan. 3, 1989 [FR] France ..... 89 00025

[51] Int. Cl.[5] ..... B23K 20/00; B23K 20/16; B23K 101/06

[52] U.S. Cl. ..... 228/127; 228/265; 228/194; 228/248

[58] Field of Search ..... 228/126, 127, 132, 133, 228/265, 194, 248

[56] References Cited

U.S. PATENT DOCUMENTS 4,765,529 8/1988 Turner ..... 228/127

FOREIGN PATENT DOCUMENTS 0155490 9/1985 European Pat. Off. ..... 228/194
17359 2/1979 Japan ..... 228/194
859080 8/1981 U.S.S.R. ..... 228/194

*Primary Examiner*—Sam Heinrich
*Attorney, Agent, or Firm*—Dennison, Meserole, Pollack & Scheiner

[57] ABSTRACT

The method according to the invention relates to the production of a bimetallic tube, the cross-section of which comprises an outer annular zone and an inner annular zone, these zones being of different compositions. The method resides in preparing a blank (1) comprising two tubular components (2, 3) housed one inside the other and of different compositions and separated by an annular space (4) which is filled with divided metal. The whole assembly is made rigid by two end pieces (7, 8) and coextrusion is carried out at a suitable temperature to ensure a metallurgical bond between the inner component (2) and the outer component (3). The bimetallic tube obtained is particularly suitable for uses in which one of its two outer or inner walls is exposed to a medium which is more aggressive than the other.

15 Claims, 2 Drawing Sheets

METHOD OF PRODUCING BIMETALLIC TUBES AND THE TUBES OBTAINED BY THIS METHOD

The invention relates to a method of producing bimetallic tubes, the cross-section of which comprises one outer annular zone and one inner annular zones, the zones being of different composition. It is applied particularly to steel tubes.

The invention also relates to the tubes obtained by this method, particularly steel tubes, and to the tubular blank which makes it possible to carry out the production method according to the invention.

Such tubes may in particular be used whenever only their outer wall or their inner wall is in contact with a fluid, the composition, the temperature or other characteristics of which require the use of a metal or an alloy of a particular composition which is of relatively high cost. It is then possible to limit the thickness of the annular zone which consists of such a metal or alloy and to use for the remainder of the cross-section of the tube a metal or alloy which is far less expensive and the essential function of which is then to ensure the mechanical strength of the tube.

A method of producing such bimetallic tubes is already known. It resides in producing a blank comprising two tubular components of different composition which are fitted one inside the other. One of the components is a stainless or refractory steel or even a refractory alloy while the other is, for example, an unalloyed or alloyed steel. These two components must be in the form of a cylinder of revolution and must be machined with the necessary accuracy for them to be fitted one into the other with the minimum of clearance. After being heated to the desired temperature, coextrusion of this blank is performed in a likewise known manner with a specific ratio of reduction in cross-section in order to produce a bimetallic tube. It is found then that, if the composition of the metals or alloys involved, the surface condition of the walls which are in contact and also the extrusion conditions are suitable, a satisfactory joint of a metallurgical nature is obtained between the two components.

In practice, the method is relatively expensive to carry out, particularly because it is necessary for precise machining of the two components of the blank. Each of the two components must be machined in such a way that it is of a constant thickness. Furthermore, for the two components, machining of the inner wall over a relatively long length presents difficulties which make it expensive. Finally, special precautions possibly have to be taken to limit oxidation of the facing walls of the two components of the blank while it is being heated and prior to coextrusion. Additional difficulties reside in the difference in the coefficient of expansion which more often than not exists between the two components of the blank. Indeed, one of the two components is often an austenitic steel or other alloy having a coefficient of expansion which is far higher than that of the other component which is an unalloyed or low-alloy steel.

When it is the outer component which has the higher expansion coefficient, an increase in the clearance between the components may be observed while the blank is being heated. This increase may be a cause of oxidation and may at the time of coextrusion produce irregularities in flow of one of the components in relation to the other upon passage through the die. When, on the other hand, it is the inner component which has the greater expansion coefficient, the two components become jammed one against the other when heated.

Attempts have been made to find a way of simplifying the method of producing bimetallic tubes by coextrusion in order to make it more reliable, more reproducible and more economical.

In particular, attempts have been made to find a way of overcoming the need for accurate inter-fitment of the two components of the blank into each other with a minimal clearance One has also sought a way of using inner and outer components which have different expansion coefficients with no notable risk of oxidation on heating or anomalies in flow during the course of coextrusion.

Finally, one has sought ways of effectively protecting the facing walls of the two components from oxidation during heating of the blank prior to coextrusion.

The method which is the object of the invention makes it possible to achieve these results and to obtain a bimetallic tube which has none of the defects noticed in those produced by the known method. This bimetallic tube is also the object of the invention.

The method of producing a bimetallic tube by coextrusion under heat according to the invention resides in producing a blank having two coaxial tubular components of revolution. These two components consist of metals or alloys of different compositions which are fitted coaxially one into the other.

The cross-sections of each of these tubular components are so determined, in a plane at right-angles to the common axis, as to provide between their facing walls an annular space having a radial width which is not less than 3 mm; the radial width of this annular space is preferably at least equal to 2% of the outside diameter of the inner component and is not greater than the radial width of the tubular component having the smallest thickness. This annular space is filled with a divided alloy or metal the composition of which is compatible with the compositions of the two tubular components, then, at each of the two ends, the space is closed by closure means. The blank is then heated to the extrusion temperature which is determined in accordance with the characteristics of the metals or alloys of which it consists, whereupon the coextrusion of the blank is performed, using a press and passing the blank through a die in order to obtain a bimetallic tube, the ratio of reduction between the solid cross-section of the blank and that of the bimetallic tube obtained being at least equal to 4.

Preferably, the radial width of the annular space is not substantially greater than 10 mm.

Advantageously, the blank comprises a first tubular component which consists of a non-alloyed steel or an alloyed steel or even a stainless steel, the second tubular component consisting of a different material such as a stainless or refractory steel or a stainless or refractory alloy containing in toto at least 50 by mass of elements from the group comprising Co, Cr, Mo, Ni or a nickel-based alloy.

Preferably, when the first tubular component is of stainless steel and the second tubular component is of stainless or refractory steel, the content in terms of elements of addition in the steel of the second component is greater than that of the steel in the first component. Preferably, the radial width of the wall of the first component is greater than that of the wall of the second component. Preferably, too, the mechanical characteristics of resistance to deformation of the steel of the first component are superior to those of the steel or alloy of the second component.

According to the envisaged applications of the bimetallic tube obtained by the method according to the invention, so the first tubular component of the blank is the outer component or inner component, the second tubular component of the blank being respectively the inner component or outer component.

Preferably, the divided alloy or metal with which the annular space is filled consists for the most part of granules which are advantageously of a substantially spherical general shape, their mean diameter being less than 1 mm. This divided alloy or metal may be of any material compatible with the composition of the first and second tubular components. It may, for instance, be a non-alloyed or an alloyed or a stainless steel or a stainless or refractory alloy containing in toto at least 50% by mass of elements from the group comprising Co, Cr, Mo, Ni or a nickel-based alloy. Preferably, the divided alloy or metal is packed into the annular space in such a way as to attain an apparent density of at least 50% of the actual density of this metal or alloy.

Preferably, the means of closing the annular space of the blank are two metallic end pieces disposed at the two ends of the blank. These end pieces are advantageously of non-alloyed or alloyed steel.

Preferably, too, each end piece is connected to the corresponding ends of each component of the blank by sealing-tight annular welded beads. Possibly, a vacuum may be established in the annular space before heating the blank to the extrusion temperature.

The blank is extruded by means of a press comprising a piston fitted with a rod which engages the blank, previously housed in a container and then in the die which is rigid with it. Thus the blank and therefore its components are caused to flow through the annular space comprised between the rod and the die, lubrication being provided by a layer of glass.

The invention likewise relates to the tubular blank comprising the two coaxial tubular components, the structure of which has been described hereinabove, and which make it possible to carry out the method according to the invention.

The invention likewise relates to a seamless bimetallic tube of revolution which is produced by coextrusion; this tube comprises an outer layer and an inner layer consisting of different alloys or metals bonded inter se in a metallurgical fashion by a joining layer emanating from a divided metal; this, during the course of the coextrusion process, is welded to itself and to the inner component and the outer component.

The ensuing drawings and examples describe in a non-limitative fashion two particular embodiments of the method of producing bimetallic tubes according to the invention.

Figure 1:
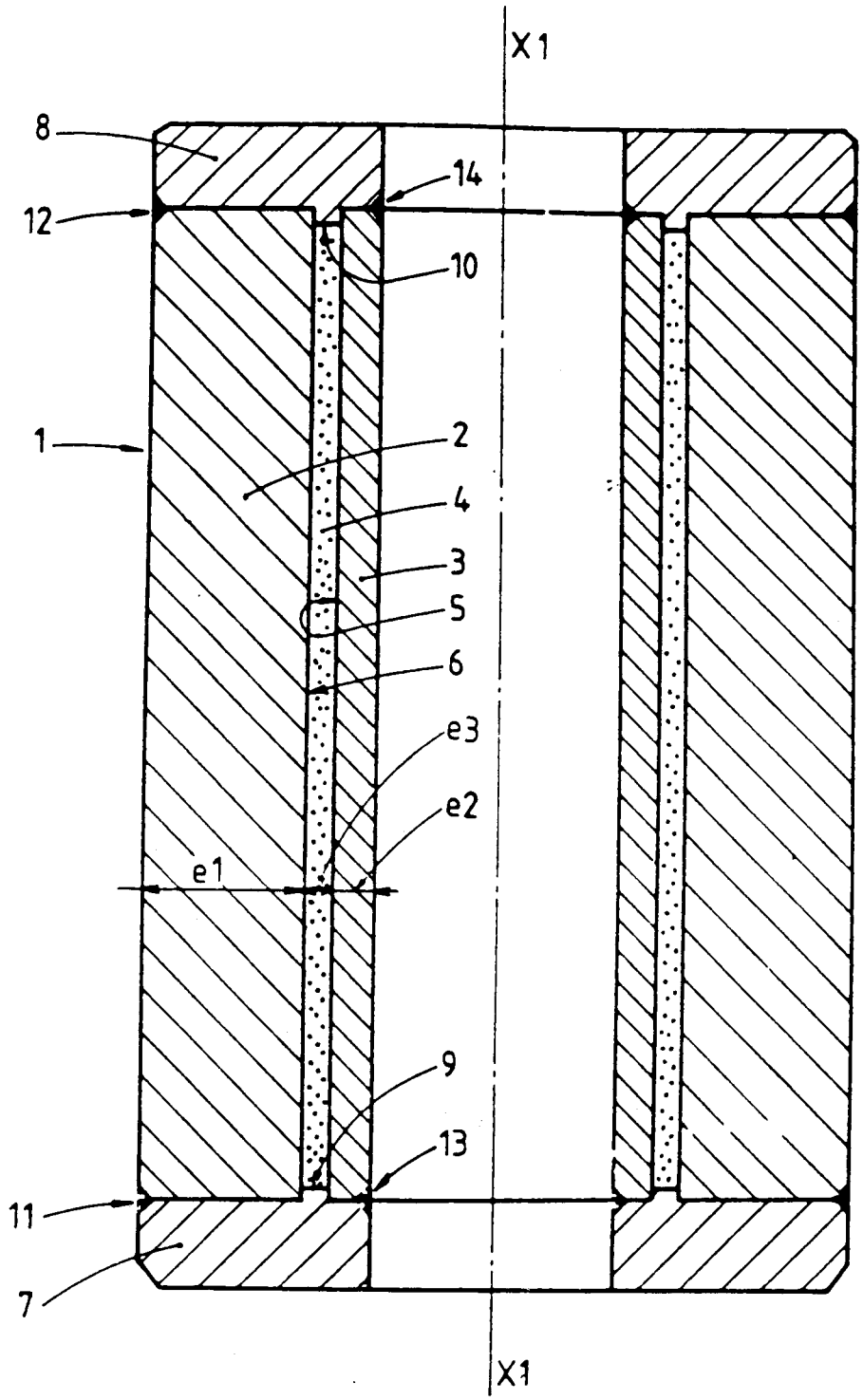
FIG. 1 is a cross-sectional view of a blank which makes it possible to produce by the method according to the invention a bimetallic tube, the first tubular component of the blank being the outer component.

FIG. 1 shows a blank 1 which makes it possible according to a first embodiment of the method according to the invention to produce a bimetallic tube which by itself forms part of the invention. This blank 1 seen in cross-section in a plane containing the axis XI—XI comprises two tubular components 2, 3 having cylindrical walls of revolution disposed one in the other coaxially in respect of XI—XI. The first tubular component 2 which is of the greater radial thickness "e1" is an outer component and consists of a low alloy steel, the total content of elements of addition in which is less than 5%. This thickness "e1" is more than two times greater than that "e2" of the second tubular component 3 which constitutes the inner component of the blank. An annular space 4 is provided between the outer wall 5 of the second tubular component 3 and the inner wall 6 of the first tubular component 2. The radial width "e3" of this annular space 4 is, in the case of this FIG. 1, far less than the radial width "e2" of the second tubular component 3. This radial width "e3" may be closer to the radial thickness "e2" of the second tubular component 3, the thinner of the blank, without however exceeding it. The second tubular component 3 may be produced, according to its intended use. from a stainless or refractory steel or from an alloy containing in toto at least 50% by mass of elements from the group comprising Co, Cr, Mo, Ni or a nickel-based alloy. Two annular end pieces 7, 8 are each disposed at one end of the blank 1. These two end members 7, 8 may be of a non-alloyed or low-alloy steel; they may have a composition close to that of the tubular component of the blank which has the thicker wall. This composition is in particular intended to allow a sealing-tight junction by welding with the two tubular components 2, 3 of the blank 1. These two end pieces 7, 8 ensure centring of the two tubular components 2 and 3 in respect of the common axis XI—XI thanks to annular ribs 9, 10 which engage between them.

Before the final positioning of at least the latter of these two end pieces, the annular space 4 is filled with a divided alloy or metal the composition of which is compatible with the compositions of the two tubular components. This divided alloy or metal may be chose, for example, from among the non-alloyed, alloyed, stainless or refractory steels or from the alloys containing in toto at least 50% by mass of elements from the group comprising Co, Cr, Mo Ni.

This divided metal is preferably in the form of granules of mostly substantially spherical form and having a mean diameter which is less than 1 mm.

This divided alloy or metal is packed into the annular space 4 by any suitable method in order to obtain an apparent density at least equal to 50% of the actual density. In particular, this packing may be carried out by vibration or compression. After the last of the two end pieces 7, 8 has been placed in position, a sealing-tight connection is made between each of them and the corresponding ends of the tubular components 2, 3 by sealing-tight annular weld beads 11, 12, 13, 14. To avoid over-thicknesses and to permit of satisfactory penetration, chamfers are formed which are inclined at approx. 45° on the end edges of the tubular components and the end pieces in the areas where these weld beads are to be made.

Then the blank 1, which has been suitably prepared, is heated by a known means such as a gas oven, or an electrically heated radiation or induction oven or a salt bath oven or the like. The heating temperature depends on the one hand on the characteristics of the metals or alloys which constitute the blank and on the other on the coextrusion conditions: strength of the press, dimensions of the blank, ratio of reduction in cross-section, kind of lubricant employed. This heating temperature is in excess of 1000°C. The lubricants which give the best results are glass. The reduction ratio between initial cross-section of the blank and the final section of the resultant tube must be at least 4 and preferably at least 6 in order to obtain a good metallurgical bond by means of the layer of divided metal between the outer and inner layers of the tube obtained from components 2, 3 of the blank. The compositions and the thicknesses of the two tubular components 2, 3 of the blank 1 are determined according to the conditions of use of the bimetallic tube obtained. As a general rule, the first component 2, less alloyed, is in contact with the least corrosive fluid and its thickness is determined essentially in order to impart the necessary mechanical strength to the tube. This explains why this first component is more often than not thicker than the second. The composition of the second component 3 is chosen for its resistance to corrosion from the most corrosive fluid. In the case shown in FIG. 1, this fluid is that which circulates inside the tube. Experience shows that a wise choice of the metal or alloy constituting this second component makes it possible to provide for minimal wear and therefore relatively minimal thickness of this component 3 in respect of the thickness of the first component 2 needed to ensure the mechanical strength of the tube.

As a practical example of embodiment of this first way of implementing the method according to the invention, a blank 1 is prepared which has a structure similar to that in FIG. 1. It comprises: a first external component 2 of 223 mm outside diameter, 140 mm inside diameter and 870 mm long and consisting of carbon steel with small additions of Mn and V of type 20 MV6 (AFNOR Standard), a second internal component 3, of 126 mm outside diameter, 100 mm inside diameter and 870 mm long and consisting of type AISI 316 stainless steel (AISI Standard).

The annular space 4 between the two components 2, 3 is 7 mm in radial width and is filled with divided stainless steel type AISI 316 L for the most part in the form of substantially spherical granules of a diameter of between 0.1 and 1 mm. Vibration packing makes it possible to achieve an apparent density of approx. 60% of the actual density. This annular space is occluded by two end plates 7, 8 which are likewise of type 20 MV6 carbon steel. Each of these plates is provided with an annular rib 9, 10 a few millimeters in height which fits into the annular space 4 which is filled with divided stainless steel. These two end plates 7, 8 are each connected to the two components 2, 3 by sealing-tight weld beads 11, 12, 13, 14 made by arc welding under argon.

This blank is then heated to a temperature of between 1150 and 1200° C. in a gas fired oven and then, after it has been coated in conventional manner with a layer of lubricant glass, both on the outer surface and on the inner surface, the blank is introduced into the container of a press and coextrusion is carried out through a die 117 mm in diameter. The piston of the press is fitted with a rod 94 mm in diameter so that, after extrusion and then removal of the glass, a bimetallic tube can be obtained which is 114.3 mm in outside diameter and 92.6 mm in inside diameter. The reduction ratio between the cross-section of the blank 1 and that of the resultant tube is therefore approx. 9.3.

Micrographic examinations carried out on samples taken at a plurality of locations on the bimetallic tube show an excellent metallurgical bonding achieved by means of the layer of divided metal between the outer coating and inner coating at the time the product passes through the die. This layer of divided metal also makes it possible, prior to coextrusion and during the phase of heating up the blank, to absorb the differential radial expansion phenomena of one component in relation to the other; this bonding coating also makes it possible, during coextrusion, for one of the two components of the blank to slide in relation to the other with no risk of tearing, cracking or creasing.

Figure 2:
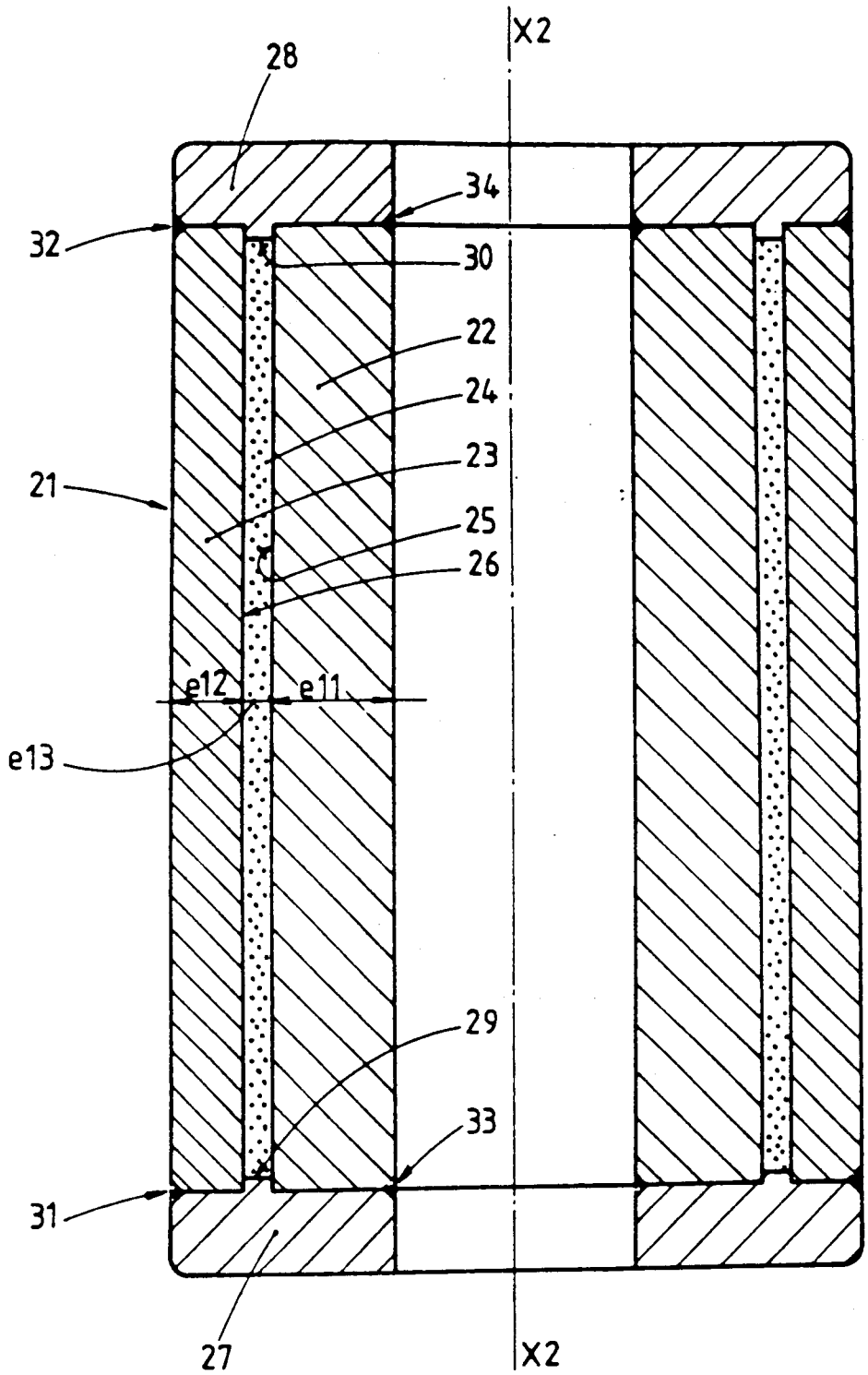
FIG. 2 is a sectional view of a blank which makes it possible by the method according to the invention to produce a metallic tube, the first tubular component of this blank being the inner component.

FIG. 2 shows a blank 21 which makes it possible according to a second embodiment of the method according to the invention to produce a metallic tube which in itself also forms part of the invention. This blank, seen in section on a plane containing its axis X2—X2 comprises two tubular components 22, 23 having walls which are cylinders of revolution disposed one in the other coaxially in relation to X2—X2. The first tubular component 22 is an internal component and consists of carbon steel. Its radial thickness, e11, is greater than the thickness e12 of the second tubular component 23 which is external. Provided between these two components is an annular space 24 comprised between the outer wall 25 of the first tubular component 22 and the inner wall 26 of the second tubular component 23. The radial width e13 of this annular space is in the case of this blank far less than the radial thickness e12 of the outer component 23 while being greater than 2% of the outside diameter of the inner component 22 and not less than 3 mm and not greater than 10% mm. The second outer component 23 is of a stainless or refractory steel or even an alloy containing in toto at least 50% by mass of elements of the group comprising Co, Cr, Mo, Ni.

Two annular end pieces 27, 28 of carbon steel provide for centring of the two components 22, 23 by means of annular ribs 29, 30. Before the last end piece is placed in position, the annular space 24 is filled with a divided alloy of metal the composition of which is compatible with the compositions of the two tubular components and which is preferably in the form of granules which are for the most part substantially spherical and of a mean diameter which is preferably less than 1 mm. This divided metal may be a carbon steel, alloyed or not, a stainless or refractory steel or even an alloy containing in toto at least 50% by mass of elements from the group comprising Co, Cr, Mo, Ni. This divided metal is packed by vibration to obtain an apparent density at least equal to 50% of the actual density. The end pieces 27, 28 are connected at the corresponding ends of the components 22, 23 by annular and sealing-tight weld beads 31, 32, 33, 34.

Using a known means, the blank 21 which is thus prepared is heated to a suitable temperature in excess of 1000° C. In known manner, this temperature is determined by taking into account the characteristics of the metals or alloys which constitute the blank and the conditions of extrusion. Extrusion is then carried out in a per se known manner in that the blank, after it has been coated in known manner on both its outer and inner surfaces with a lubricant glass, is introduced into the container of an extrusion press which is fitted with a die. The blank is propelled by means of a piston provided with a rod which passes through the blank and engages the die. Lubrication is preferably carried out by means of glass. The cross-sections of the rod, of the die and of the blank are determined in such a way as to obtain a reduction ratio of at least 4 and preferably at least 6.

By way of example, a blank is prepared having a structure similar to that in FIG. 2 comprising a first inner component 22 of carbon steel, type 20 MV6 (AFNOR Standard), 189 mm outside diameter, 60 mm inside diameter and 870 mm long. The second outer component 23 of stainless steel 316 (AISI Standard) has an outer diameter of 223 mm, an inside diameter of 200 mm and a length of 870 mm. The surface conditions of the facing walls forming the annular space are prepared in such a way as to avoid any presence of oxide. For example, prior to assembly of the blank, these walls may be brushed or ground. The annular space 24 of 5.5 mm radial width is filled with divided stainless steel type 316 (AISI Standard), for the most part consisting of substantially spherical granules of a diameter between 0.1 and 1 mm. Aft vibration packing, the apparent density of this divided steel is approx. 60% of its true density. Once the end pieces 27, 28 of 20 MV6 steel have been placed in position, they are connected to the two components 22, 23 by sealing-tight weld beads 31, 32, 33, 34 made by arc welding under argon.

The blank which is thus prepared is heated to between 1050 and 1200° C. in a gas fired furnace and then, after being coated with a layer of lubricant glass in known manner both on the outer surface and on the inner surface, coextrusion is carried out by means of a press. The piston of the press comprises a rod which is 52.1 mm in diameter and which fits into the blank 21 and then into the die which is 66 mm in diameter.

After coextrusion and then removal of the glass, a bimetallic tube is obtained with an outside diameter of approx. 63.5 mm and an inside diameter of approx. 51.3 mm. The reduction ratio in respect of the initial cross-section of the blank of 223 mm outside diameter and 60 mm inside diameter is approx. 31.

Micrographic examinations carried out on samples taken from a number of locations on the bimetallic tube show an excellent metallurgical bond achieved by means of the divided metal layer between the inner coating and the outer coating of the tube. Furthermore, having regard to the characteristic features of the method, it is possible to use, for the two components, tubular products which do not require close tolerances, particularly for the facing surfaces which form the annular space which makes it possible to reduce manufacturing costs.

For certain applications, it may be necessary prior to pre-heating, to eliminate the remaining air contained in the annular space 24 which is filled with divided alloy or metal. This may be carried out by establishing a vacuum in this annular space by a passage provided in one end piece. A closure means then makes it possible to occlude this passage prior to heating of the blank or no later than prior to coextrusion.

Many variations may be made to the method according to the invention without departing from the field covered by the invention.

The same applies to the bimetallic tubes which are the object of the invention.

We claim:

1. A method of producing a bimetallic tube by coextrusion under heat of a blank comprising two tubular components of revolution consisting of metals or alloys of different compositions fitted coaxially one into the other, characterised in that the cross-sections of each of these tubular components (2, 3, 22, 23) in a plane at right-angles to the common axis are established in such a way as to provide between their facing walls (5, 6, 25, 26) an annular space (4, 24) of radical width (e3, e13) which is not less than 3 mm, at least equal to 2% of the outside diameter of the inner component and no greater than that of the tubular component (3, 23) of lesser thickness, and then in that a divided alloy or metal, the composition of which is compatible with the compositions of the two tubular components, is used to fill this annular space (4, 24) which is then closed in sealing-tight fashion by closure means (7, 8, 27, 28) disposed at the two ends and in that the blank (1, 11) is heated to the extrusion temperature determined according to the characteristic features of the metals or alloys which constitute it, and in that coextrusion of the blank is carried out by means of a press through a die in such a way as to produce a bimetallic tube, the ratio of reduction between the solid cross-section of the blank and that of the bimetallic tube obtained being at least 4.

2. A method according to claim 1, characterised in that the annular space (4, 24) has a radial width which is not substantially greater than 10 mm.

3. A method according to claim 1, characterised in that the black comprises a first tubular component (2, 22) of a non-alloyed or alloyed or stainless steel and a second tubular component (3, 23) made from a different material such as a stainless or refractory steel or a stainless or refractory alloy containing in toto at least 50% by mass of elements from the group comprising Co, Cr, Mo, Ni or a nickel-based alloy.

4. A method according to claim 3, characterised in that when the first component is stainless steel and the second component is stainless or refractory steel, the content of elements of addition of the steel in the second component is greater than that of the steel in the first component.

5. A method according to claim 3, characterised in that the radial width of the wall of the first component (2, 22) is greater than that of the wall of the second component (3, 23).

6. A method according to claim 3, characterised in that the mechanical characteristics of resistance to deformation of the steel in the first component (2, 22) are better than those of the steel or alloy in the second component (3, 23).

7. A method according to claim 1, characterised in that the divided alloy or metal with which the annular space (4, 24) is filled consists for the most part of substantially spherical granules having a mean diameter less than 1 mm.

8. A method according to claim 1, characterised in that the divided alloy or metal is a non-alloyed or alloyed steel or a stainless steel or a stainless or refractory alloy containing in toto at least 50% by mass of elements from the group comprising Co, Cr, Mo, Ni.

9. A method according to claim 1, characterised in that the divided alloy or metal is packed into the annular space (4, 24) in such a way as to achieve an apparent density of at least 50% of the true density of this metal or alloy.

10. A method according to claim 3, characterised in that the first component of the blank is the outer component (2).

11. A method according to claim 3, characterised in that the first component of the blank is the inner component (22).

12. A method according to claim 1, characterised in that the means of closing the annular space (4, 24) of the blank (1, 21) are two annular metallic end pieces (7, 8, 27, 28) disposed at the two ends of the blank.

13. A method according to claim 12, characterised in that each end piece (7, 8, 27, 28) is connected to the two corresponding ends of each component of the blank by sealing-tight annular weld beads (11, 12, 13, 14, 31, 32, 33, 34).

14. A method according to claim 1, characterised in that a vacuum is established in the annular space (4, 24) prior to heating the blank (1, 21) to the extrusion temperature.

15. A method according to claim 1, characterised in that coextrusion of the blank is carried out by means of a press comprising a piston fitted with a rod which engages the blank which is previously housed in a container and then a die rigid with this container, the said piston thus causing flow of the components of the blank through the annular space comprised between rod and die, lubrication being provided by a glass coating.

* * * * *